United States Patent [19]

Grossman et al.

[11] Patent Number: 5,068,533

[45] Date of Patent: Nov. 26, 1991

[54] MANIFOLD AND METHOD OF BATCH MEASUREMENT OF HG-196 CONCENTRATION USING A MASS SPECTROMETER

[75] Inventors: Mark W. Grossman, Belmont, Mass.; Roger Evans, N. Hampton, N.H.

[73] Assignee: GTE Products Corporation, Danvers, Mass.

[21] Appl. No.: 323,737

[22] Filed: Mar. 15, 1989

[51] Int. Cl.[5] ..... H01J 49/04

[52] U.S. Cl. ..... 250/288; 250/281; 250/282; 250/424; 250/425

[58] Field of Search ..... 250/288 A, 424, 475, 250/288 R, 281, 282, 423 R

[56] References Cited

U.S. PATENT DOCUMENTS

| | | | |
|---|---|---|---|
| 3,897,331 | 7/1975 | Smith et al. . | |
| 3,983,019 | 9/1976 | Bergheaud et al. . | |
| 4,209,696 | 9/1980 | Fite | 250/288 A |
| 4,298,795 | 11/1908 | Takeuchi et al. | 250/288 A |
| 4,379,252 | 4/1983 | Work et al. . | |
| 4,514,363 | 4/1985 | Dubrin . | |
| 4,527,086 | 7/1985 | Maya . | |
| 4,531,056 | 7/1985 | Labowsky et al. | 250/288 A |
| 4,607,163 | 8/1986 | Mizuno | 250/288 A |
| 4,647,772 | 3/1987 | Lewis et al. | 250/288 A |
| 4,648,951 | 3/1987 | Maya . | |
| 4,678,550 | 7/1987 | Grossman et al. . | |
| 4,713,547 | 12/1987 | Grossman . | |
| 4,789,784 | 12/1988 | Grossman et al. . | |
| 4,793,907 | 12/1988 | Paisner et al. | 250/424 |
| 4,800,284 | 1/1989 | Grossman et al. . | |
| 4,879,010 | 11/1989 | Grossman et al. . | |
| 4,933,548 | 6/1990 | Boyer et al. | 250/288 |

FOREIGN PATENT DOCUMENTS

| | | |
|---|---|---|
| 0280788 | 9/1988 | European Pat. Off. . |
| 0281687 | 9/1988 | European Pat. Off. . |

OTHER PUBLICATIONS

Maya et al., "Science", 226:435–436 (1984).
Webster and Zare, "J. Phys. Chem.", 85:1302 (1981).
McDowell et al., "Can. J. Chem.", 37:1432 (1959).
Gunning and Swartz, "Adv. Photochem.", 1:209 (1963).
Waymouth, "Electric Discharge Lamps", MIT Press (1971).
Osborn et al., J. of the Optical Society of America, vol. 45, p. 552, 7/55.

*Primary Examiner*—Jack I. Berman
*Assistant Examiner*—Kiet T. Nguyen
*Attorney, Agent, or Firm*—Martha Ann Finnegan

[57] ABSTRACT

A sample manifold and method of its use has been developed so that milligram quantities of mercury can be analyzed mass spectroscopically to determine the $^{196}Hg$ concentration to less than 0.02 atomic percent. Using natural mercury as a standard, accuracy of ±0.002 atomic percent can be obtained. The mass spectrometer preferably used is a commercially available GC/MS manufactured by Hewlett Packard. A novel sample manifold is contained within an oven allowing flow rate control of Hg into the MS. Another part of the manifold connects to an auxiliary pumping system which facilitates rapid clean up of residual Hg in the manifold. Sample cycle time is about 1 hour.

3 Claims, 6 Drawing Sheets

RIGHT SIDE VIEW

FRONT VIEW

AVERAGE OF 0.100 TO 3.000 MIN. FROM DATA:HGS047.0
HG BACK AFT 70 MIN

| M/Z | ABUND. | M/Z | ABUND. | M/Z | ABUND. | M/Z | ABUND. |
|---|---|---|---|---|---|---|---|
| 195.00 | 180 | 198.00 | 1875 | 201.00 | 2579 | 204.00 | 1427 |
| 196.00 | 187 | 199.00 | 3157 | 202.00 | 5743 | 205.00 | 199 |
| 197.00 | 186 | 200.00 | 4396 | 203.00 | 173 | | |

AVERAGE OF 0.100 TO 3.000 MIN. FROM DATA: HG5046.D
EFFLUENT 10-31-85-1 10 MIN OVEN

| M/Z | ABUND. | M/Z | ABUND. | M/Z | ABUND. | M/Z | ABUND. |
|---|---|---|---|---|---|---|---|
| 195.00 | 317 | 198.00 | 225192 | 201.00 | 310482 | 204.00 | 175705 |
| 196.00 | 2676 | 199.00 | 379657 | 202.00 | 717532 | 205.00 | 153 |
| 197.00 | 708 | 200.00 | 533676 | 203.00 | 226 | | |

MANIFOLD AND METHOD OF BATCH MEASUREMENT OF HG-196 CONCENTRATION USING A MASS SPECTROMETER

STATEMENT OF GOVERNMENT INTEREST

The Government of the United States of America has rights in this invention pursuant to Subcontract 4540710 under Prime Contract DE-AC03-76SF00098 awarded by the Department of Energy.

FIELD OF THE INVENTION

The present invention is directed to a method and apparatus useful in the isotopic enrichment of a predetermined isotope of mercury (Hg) from a naturally occurring mercury mixture. While the present invention may be used in the enrichment of any one of the seven naturally occurring isotopes of mercury ($^{202}$Hg, $^{200}$Hg, $^{199}$Hg, $^{201}$Hg, $^{198}$Hg, $^{204}$Hg, and $^{196}$Hg,) it has particularly advantageous application in the photochemical enrichment of the $^{196}$Hg isotope, which has a natural abundance of only about 0.146 percent.

Photochemical mercury enrichment processes are well known and have been well documented in the literature. See for example, Webster and Zare, *J. Phys. Chem.*, 85:1302 (1981); McDowell et al., *Can. J. Chem.*, 37:1432 (1959); Gunning and Swartz, *Adv. Photochem.*, 1:209 (1963) and U.S. Pat. Nos., 4,678,550, 4,648,951, and 4,514,363, the teachings of which are hereby incorporated herein by reference.

BACKGROUND OF THE INVENTION

Many devices utilize mercury in their operation, particularly in the field of electric lamps and lighting. Such devices include arc discharge lamps which typically employ mercury as one of the vaporizable components therein. See, for example, Waymouth, *Electric Discharge Lamps,* MIT Press 1971 for a description of the basic principles of such lamps.

In U.S. Pat. No. 4,379,252, (the '252 patent), the advantages of utilizing higher than normal levels of $^{196}$Hg in the Hg added to fluorescent lamps are described and include unexpectedly high efficiency gains in light output. The disclosure of this patent is hereby incorporated herein by reference.

The drawback of using this isotope lies in its high cost. For example, using conventional enrichment techniques, mercury which has been enhanced to contain about 35% of the $^{196}$Hg isotope can cost about $500 per milligram. While only sub-milligram quantities of this isotope need be added to a fluorescent lamp to afford beneficial results, economic realities always play a part in consumer products. Accordingly, it is easy to understand why more economical methods of obtaining this isotope continue to be sought.

Isotopically enriched mercury can be produced by a number of methods. One method involves photosensitized chemical reactions utilizing elemental mercury and various compounds. The compounds HCl and $O_2$ react with mercury atoms when the mercury atoms are excited by resonance radiation, in particular, 2537Å radiation produced in a Hg ($^3P$-$^1S_0$) transition generating isotopically selective reactions. Thus, the Hg compound formed contains Hg enriched in a particular isotope, and the Hg must be separated from the compound into its liquid for free state (i.e., elemental Hg) in order to recover the isotopically enriched metal.

INFORMATION DISCLOSURE

The following documents are recited as general background information with respect to the subject matter of the present invention. To the extent deemed necessary by artisans of ordinary skill in the art to which this invention pertains, the teachings of these documents are thereby incorporated herein by reference.

Grossman, U.S. Pat. No. 4,713,547;
Grossman et al., U.S. Pat. No. 4,678,550;
Maya, U.S. Pat. No. 4,527,086;
Durbin, U.S. Pat. No. 4,514,363;
Work et al., U.S. Pat. No. 3,379,252;
Botter nee Bergheaud et al., U.S. Pat. No. 3,983,019;
Smith et al., U.S. Pat. No. 3,897,331;
Grossman et al., U.S. Ser. No. 815,150, filed Dec. 31, 1985;
European Patent Publication No. 0 281 687, published Sept. 14, 1988, claiming priority of U.S. Ser. No. 947,217, filed Dec. 29, 1986;
European Patent Publication No. 0 280 788, published Sept. 7, 1988, claiming priority of U.S. Ser. No. 947,216, filed Dec. 29, 1986;
and Maya et al., *Science,* 226:435–436 (1984).

SUMMARY OF THE INVENTION

A sample manifold and method of it's use have been developed so that milligram quantities of mercury can be analyzed mass spectroscopically to determine the $^{196}$Hg concentration to less than 0.02 atomic percent.

Using natural mercury as a standard, accuracy of ±0.002 atomic weight percent (at. %) can be obtained. The mass spectrometer preferably used is a commercially available gas chromatograph/mass spectrometer (GC/MS) manufactured by Hewlett Packard. Advantageously, the novel sample manifold is contained within an oven, allowing flow rate control of Hg into the MS. Another part of the manifold connects to an auxiliary pumping system which facilitates rapid clean up of residual Hg in the manifold. Sample cycle time is only about 1 hour.

BRIEF DESCRIPTION OF THE DRAWINGS

FIG. 5 is a typical background scan. FIG. 6 is a scan for an effluent sample. Using the 195 and 197 abundances as background levels and assuming this is due to a triangular wing from the higher mass peaks, gives a $^{196}$Hg concentration of 0.092 atomic percent.

DETAILED DESCRIPTION OF THE PREFERRED EMBODIMENTS

Mass spectroscopic measurements of small concentrations of an isotope are normally difficult due to background and parent wing overlap. Additionally, in the case of Hg, chemical (amalgamation) and physical (adhesion, slow pump out) processes make it desirable to utilize a minimum of sample. Some of the problems of isotope analysis of Hg via mass spectrometry are described in Osborn and Gunning, *J. Optical Soc. Amer.*, 45:552–555 (1955), the disclosure of which is hereby incorporated herein by reference.

The measurement of the $^{196}Hg$ concentration in the effluent of a photochemical $^{196}Hg$ isotope enrichment process is one method for determining the feedstock utilization concentration [wherein $^{196}Hg$ concentrations of 0.07 atomic percent are common]. This had previously been done mass spectrometrically by utilizing an insertion probe to introduce a Hg-Ag amalgam into a Hewlett-Packard 5970 GC/MSD mass spectrometer.

In contrast thereto, the procedure of the present invention does not require an insertion probe or amalgamation of the sample. This results in a simplification both of the equipment and technique required.

Figure 1A:
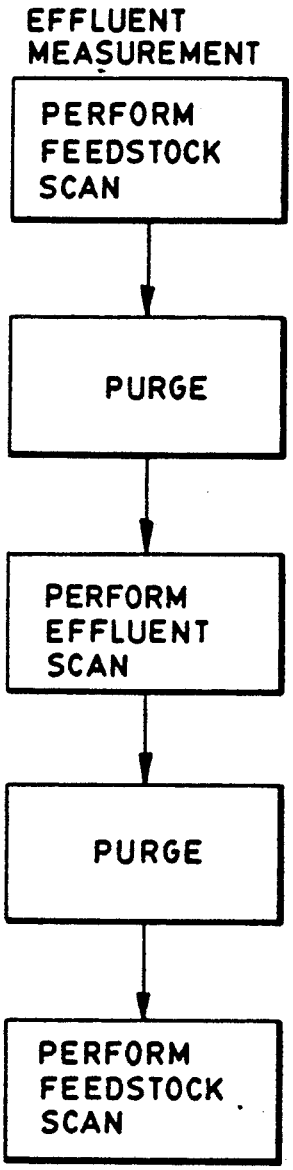
FIG. 1(A–B) are schematic diagrams illustrating isotope measurement using the process and apparatus of the present invention.
Figure 1B:
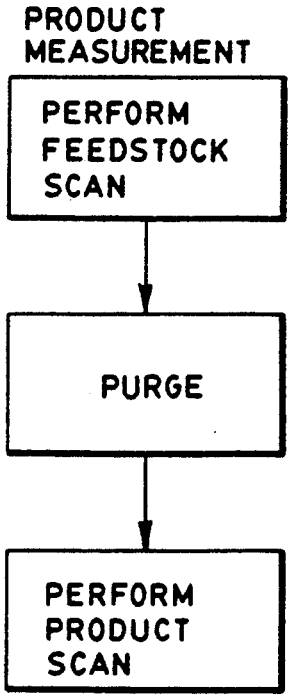

FIG. 1 illustrates in a flow chart scheme, the process of the present invention. As illustrated, the process comprises two main steps; effluent measurement and product measurement. In each of these two steps the initial step is the performance of a feedstock scan; followed by a purge, then either an effluent or product scan, and finally another purge.

Figure 2:
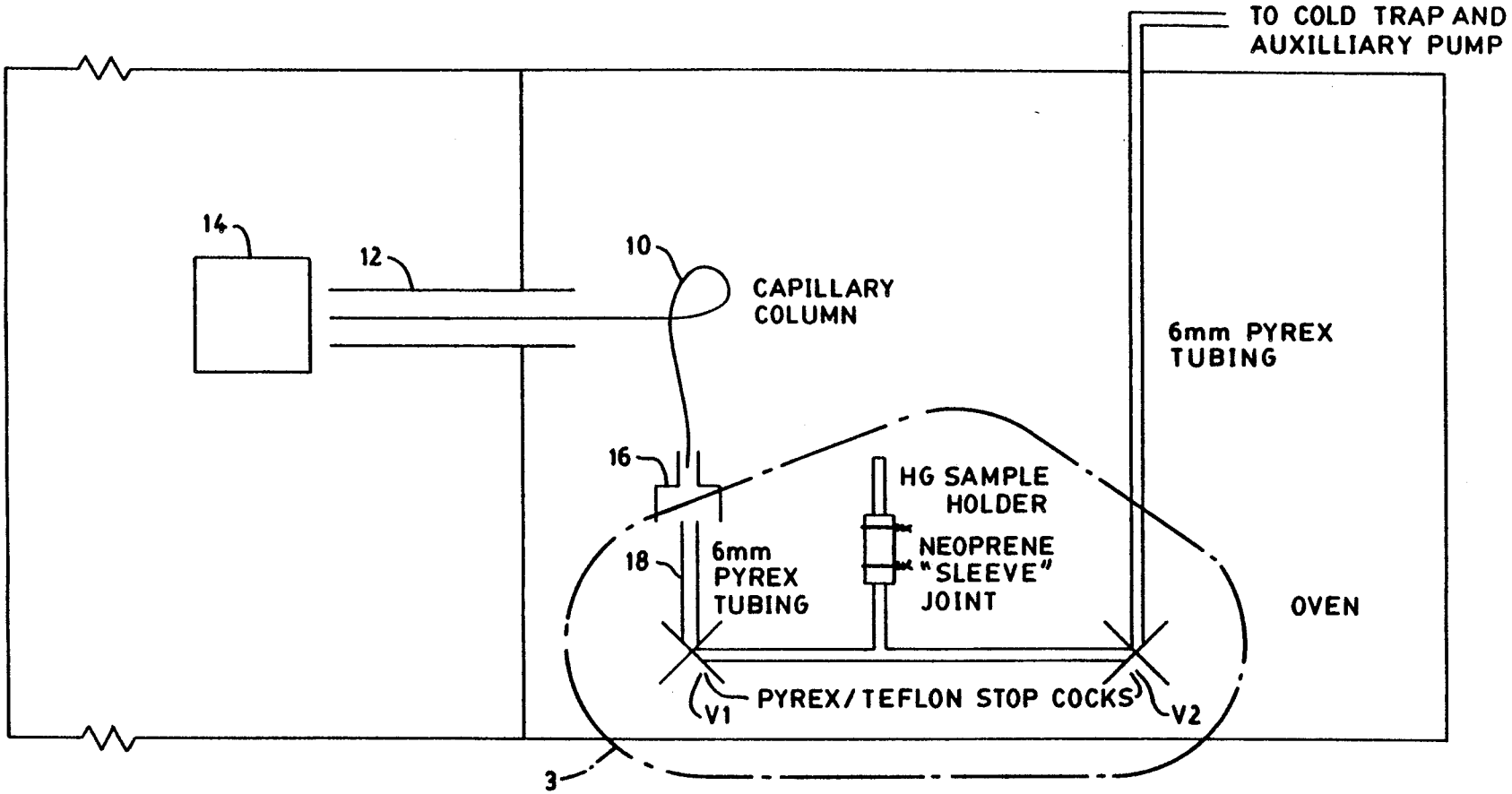
FIG. 2 is a schematic diagram of a mass spectrometer employing the manifold of the present invention.

FIG. 2 illustrates in a schematic diagram, a mass spectrometer employing the manifold of the present invention. It will be noted that except for the extended Pyrex tubing which leads to the cold trap, the entire manifold is in the oven of the mass spectrometer.

Figure 3B:
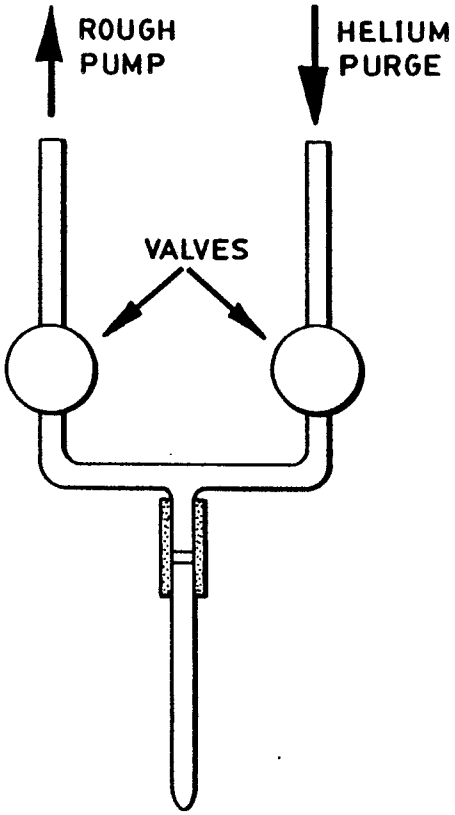
FIG. 3(A–B) illustrate two views (front and side) of the manifold of the present invention.
Figure 3A:
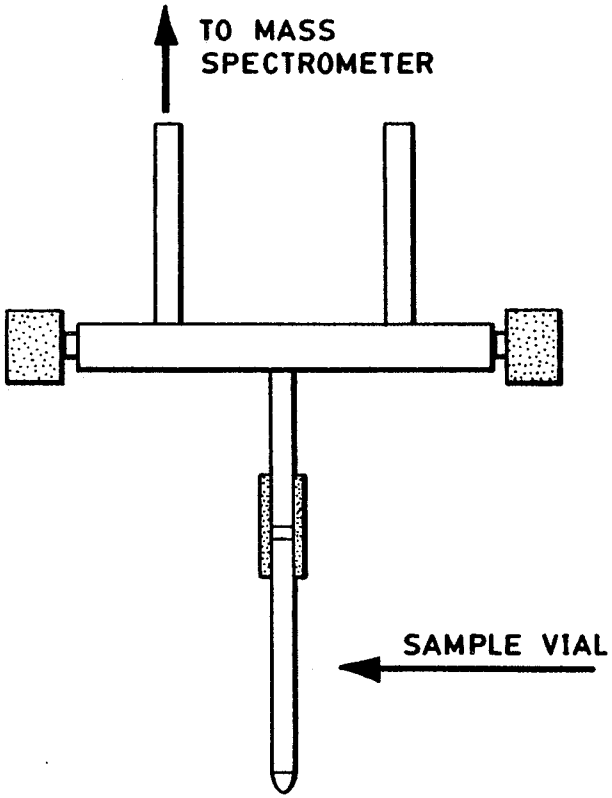

FIG. 3 illustrates in greater detail, the manifold of the present invention. The sample is normally placed in the "sample vial," a section of Pyrex tubing sealed at one end and joined to a Pyrex tube tee using a Neoprene "sleeve joint" as shown in FIG. 4.

As illustrated in FIG. 1, one end of the capillary column 10 passes through an interfacing tube 12 (also heated, but to 260° C.) and capillary 10 is initially pushed up against the MS ion source 14. Just prior to sealing the entrance of the interfacing tube 12, the capillary is pulled about 1 mm away from the ion source. The other end of the capillary tube 10 connects to a stainless steel transition fitting 16 which connects to OD Pyrex tube 18 preferably of about 6 mm OD.

Figure 4:
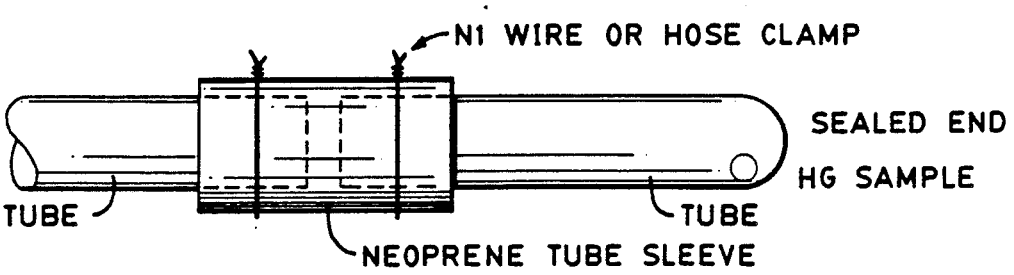
FIG. 4 illustrates sample placement in the manifold of the present invention, illustrating specifically the Pyrex tube tee using a Neoprene sleeve joint.

In the a preferred embodiment of the manifold illustrated in FIGS. 2, 3, and 4, the capillary tube 10, is about 70 cm long with a nominal OD of about 320 microns and an ID of about 270 microns. The supplier of this preferred capillary tube [under the designation SP250] is the Spectran Corp. of Sturbridge, Mass. The transition fitting 16 in the preferred embodiment is a Swaglock zero volume column and reducing union ss-400-6-1-12V, supplied by Cambridge Valve and Fitting Co., Billerica, Mass. Standard Pyrex/Teflon stop cocks, about 0.3 mm are also used in the preferred embodiment.

The preferred oven and mass spectrometer are commercially available as a single unit, the Hewlett Packard, HP 5790 GC/MS. With this commercial system a 50 meter long capillary column would be located in the oven and connect the MS to a gas chromatography interface.

Referring again to FIG. 2, the valve closest to the MS, value 1, is used to isolate the MS when the Pyrex tee and sample holder are brought to ambient pressure. The other valve, valve 2, is used to keep the sample mercury from steaming into the cold region of the system and therefore away from the MS when the sample is in place and the oven on.

The procedure for using the sample manifold of FIGS. 1 and 2 for MS analysis of a mercury sample is as follows:

A bead of mercury placed in a sample tube has just been mass analyzed. Sample sizes as small as about 0.2 mg has been used. Valve 1 is closed. Helium is emitted to valve 2 from outside the oven to a pressure of just over 1 ATM. Valve 2 is opened to backfill the sample to 1 ATM Helium. Valve 2 is immediately closed.

An empty, clean sample holder replaces the original sample and sample holder. Valve 2 is opened and the helium is pumped out. At this point the manifold temperature is below the normal temperature (about 130° C.) during which the MS measurement occurs. Valve 1 can be opened when the helium pressure is about 450 Torr (T) or lower. Two helium flushes are carried out with both valves open. In each case the manifold is pumped down to about 1 milli-Torr prior to the next flush. Then a helium fill of about 450 T is introduced and valve 2 is closed and the oven temperature is raised to about 150° C.

Next, a slower pump out of the residual Hg and helium through the capillary takes place. Typically the MS volume is pumped down to about $10^{-6}$ T in about 20 min. After a total of 60 minutes scan of the Hg isotope abundance peaks can be made. These represent the background. The background is usually low enough that the next sample can be introduced immediately.

To introduce the next sample, valve 1 is closed. A He pressure of slightly more than 1 atmosphere is introduced up to valve 2. Valve 2 is opened and closed in order to backfill the manifold with He. Generally from about 1 to 2 seconds "open" is enough time to "vent" the sample holder.

The clean sample holder is removed and a holder with a mercury sample to be measured is put in its place. The sample holder is oriented so that the sample bead does not fall into the manifold. Valve 2 is opened and the manifold is pumped down to about 1 milli-Torr. Valve 1 is also opened. Several seconds after valve 1 is opened, valve 2 is closed and the oven temperature is set to about 130° C.

Once this 130° C. temperature is reached, an approximately ten minute equilibrating time is used to allow the Hg vapor to reach a steady diffusion rate into the MS. At this point a scan is carried out and the mass analysis of the mercury sample is complete.

Tables I and II summarize the sequence of operations necessary for conducting a background scan and a product (mercury) scan using the preferred manifold of the present invention.

TABLE I

| Background Scan | |
|---|---|
| Step | Description |
| (1) | open valve 2 to rough out the manifold |
| (2) | wait until the rough pressure fails below 10 milli-torr |
| (3) | open valve 1 to rough out that portion of the manifold above valve 1 |
| (4) | wait until the rough pressure falls below 10 milli-torr |
| (5) | close valve 2 |
| (6) | start MS scan |
| (7) | check results of scan |
| (8) | repeat purge cycle if background scan baseline is above 4000 counts |
| (9) | perform mercury scan if background scan baseline is below 4000 counts |

TABLE II

| Step | Mercury Scan Description |
|---|---|
| (1) | close valve 1 |
| (2) | open valve 2 |
| (3) | isolate rough pump form rough-line |
| (4) | admit helium to rough-line/manifold until pressure equals one atmosphere |
| (5) | close helium supply |
| (6) | close valve 2 |
| (7) | remove empty sample tube |
| (8) | load a bead of mercury into a clean sample tube |
| (9) | mount sample tube onto manifold |
| (10) | open rough pump to rough-line to rough out the rough-line |
| (11) | open valve 2 to rough out the manifold |
| (12) | wait until the rough-line pressure falls below 10 milli-torr |
| (13) | open valve 1 |
| (14) | wait until the rough-line pressure falls below 10 milli-torr |
| (15) | clean valve 2 |
| (16) | wait 10 minutes to equilibrate mercury valve vapor flow rate |
| (17) | start MS scan |
| (18) | wait until MS scan completes |
| (19) | close valve 1 |
| (20) | open valve 2 |
| (21) | isolate rough pump from rough-line |
| (22) | admit helium through rough-line into manifold to one atmosphere |
| (23) | close valve 2 |
| (24) | remove sample tube |
| (25) | mount clean empty sample tube |
| (26) | open rough pump to rough-line to rough out the rough-line |
| (27) | open valve 2 to rough out the manifold |
| (28) | wait until the rough-line pressure falls below 10 milli-torr |
| (29) | open valve 1 |
| (30) | wait until the rough-line pressure falls below 10 milli-torr |
| (31) | close valve 2 |
| (32) | start purge cycle |

Figure 5:
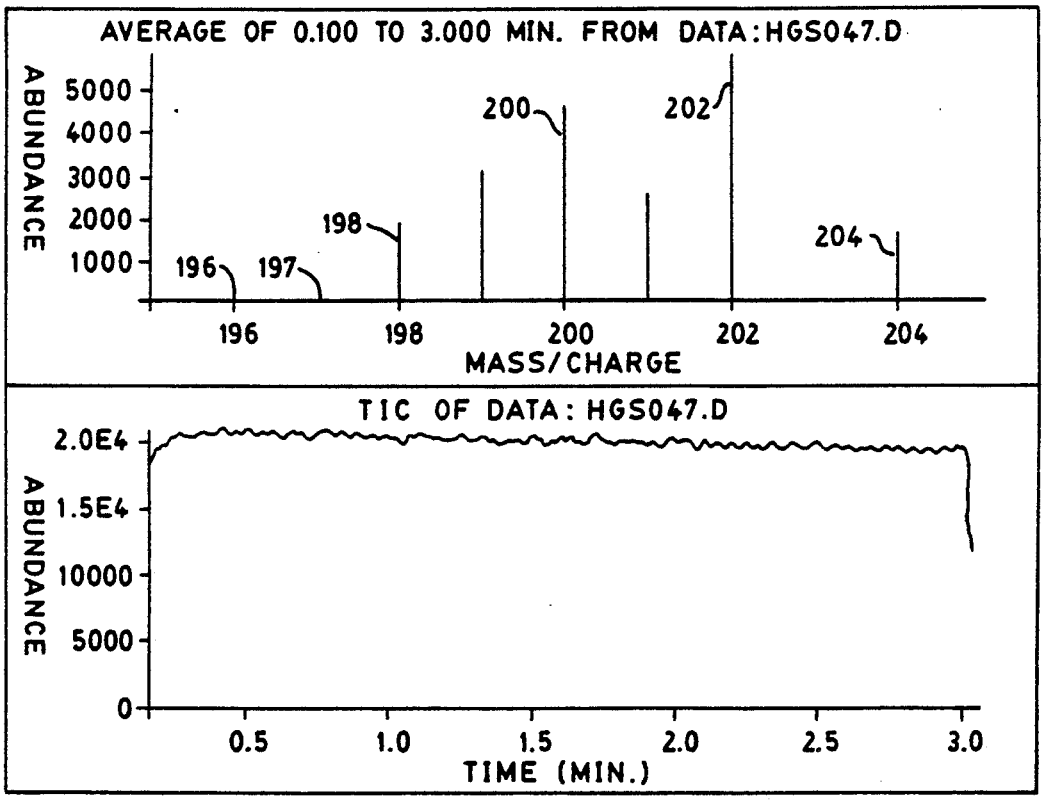
FIGS. 5 and 6 are typical MS/GC scans for the present invention.
Figure 6:
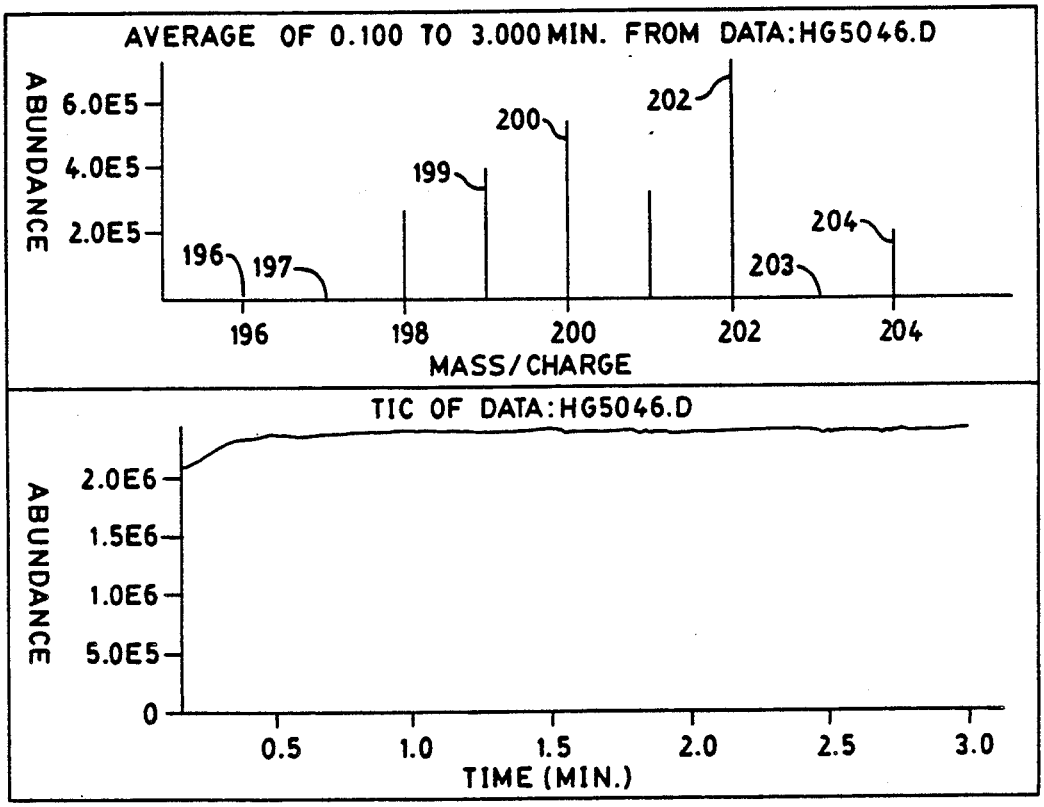

FIG. 5 shows a typical background scan. FIG. 6 is a scan for a particular effluent sample. Using the 195 and 197 abundances as background levels and assuming this is due to a triangular wing from the higher mass peaks provides a $^{196}Hg$ concentration of 0.092 atomic percent for the scan represented in FIG. 4. Other scans will naturally result in other values being obtained.

A further correction may be made as follows. The same technique is used for natural mercury isotopic distribution measurement. Here the $^{196}Hg$ is measured to be 0.140 atom percent rather than 0.146 atom percent. The final value of the $^{196}Hg$ concentration is taken to be 0.098 atom percent.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. The method of analyzing mercury vapor in a mass spectrometer using a sample manifold for use in introducing small samples of mercury vapor into a mass spectrometer for analysis thereof, said manifold comprising in combination:

(a) a capillary member in communication at one end thereof with the ion source of a mass spectrometer and a gas/vacuum inlet/outlet member at the other end thereof;

(b) said gas/vacuum inlet-outlet member comprising valve means for the vacuum purging of both the member and gaseous pressurization thereof, said member further being connected to a vacuum means and said pressurization means; and (c) a removable mercury sample holder connected to the inlet/outlet member, said method comprising the sequential steps of:

(a) measuring the effluent content by conducting the following sequence of steps:

i. performing a feedstock scan;

ii. purge;

iii. performing an effluent scan; and iv. purge;

v. performing a feedstock scan; and (b) measuring the mercury content in the gaseous system by conducting the following sequence of steps:

i. performing a feedstock scan;

ii. purge;

iii. performing a mercury scan; and iv. purge.

2. The method of claim 1, wherein said sample manifold further comprises means for heating the individual components (a), (b), and (c) of the sample manifold independently to a temperature within the range of about 100° C. to 300° C.

3. The method of claim 1, wherein the pressure/-vacuum range of components (a), (b), and (c) of the sample manifold is from about 600 Torr to about $1\times10^{-6}$.

* * * * *